US005636539A

United States Patent [19]

Tsai

[11] Patent Number: 5,636,539

[45] Date of Patent: Jun. 10, 1997

[54] MAIN BODY STRUCTURE OF COMBINATION LOCK

[76] Inventor: Cheng-Tao Tsai, No. 174, Lane 41, Chang Tung Street, Tainan, Taiwan

[21] Appl. No.: 534,627

[22] Filed: Sep. 27, 1995

[51] Int. Cl.[6] ..... E05B 37/00

[52] U.S. Cl. ..... 70/315; 70/312; 70/30

[58] Field of Search ..... 70/312, 315, 316, 70/317, 318, 323, 26, 30, DIG. 44

[56] References Cited

U.S. PATENT DOCUMENTS 3,349,586 10/1967 Russell et al. ..... 70/316

4,302,955 12/1981 Kawakami ..... 70/30

5,027,623 7/1991 Ling ..... 70/318

5,235,831 8/1993 Lauria et al. ..... 70/512

*Primary Examiner*—Darnell M. Boucher

*Attorney, Agent, or Firm*—Morton J. Rosenberg; David I. Klien

[57] ABSTRACT

A combination lock is provided wherein force is maintained by convex blocks of a thimble member to displace a setting push ring and allow setting of a new combination. The convex blocks of the thimble are engaged with arcuate edges of a push ring by rotation of the thimble. Subsequent to setting of a new combination, the thimble is rotated back to its original position.

1 Claim, 5 Drawing Sheets

1-1

2-2

3-3

4-4

MAIN BODY STRUCTURE OF COMBINATION LOCK

BACKGROUND OF THE INVENTION

A common combination lock, shown in FIG. 13, comprises: a toothed disk 23 having a gap 232, an inserting hole 231 and a plurality of protruding teeth 233 on the side wall thereof. A sliding ring 24 is provided which has an inserting hole 241 and a gap 242, and is disposed among the protruding teeth 233 of the toothed disk 23. The sliding ring 24 further has a pair of concave recesses 243 disposed on opposing sides of the outer surface of the circumferential wall thereof and a pair of convex protrusions 244 disposed on the internal surface of the circumferential wall, both pairs 243, 244 being disposed in radial alignment. Numeral dials 25 are provided having an inserting hole 252, a plurality of protruding teeth 253 equally spaced with a plurality of withholding holes 254 disposed therebetween, and a plurality of numerals equally spaced on the outer circumference thereof. Elastic fixing rings 26 are provided having an inserting hole 261 in the center, a protruding grain 262 on one side and a pair of convex protrusions 263 facing each other on the internal edge of the hole 261. A ringed controlling slider 27 is provided which has an inserting hole 271, a gap 272, a pair of convex protrusions 273 facing each other on the internal surface of the circumferential wall, a pair of concave recesses 275 are disposed on the outer surface of the circumferential wall, in radial alignment with the convex protrusions 273. The slider 27 also includes a touch-push block 274 possessing a concave recess 276 extending from one side edge thereof. Additionally, a ringed thimble 28 is included which has a protruding block 281, a concave cavity 282, an inserting hole 283 in the center and a pair of convex protrusions 284 disposed on the edge of the inserting hole 283.

In assembling the lock, first the sliding ring 24 is mounted into the cavity formed by the protruding teeth 233 of the toothed disk 23. The convex protrusions 244 are engaged with a pair of concave recesses 211 of a socket 21. Then the convex protrusions 263 of the elastic fixing ring 26 are engaged with the concave recesses 243 of the sliding ring 24 to secure each other.

The numeral dial 25 is connected to the protruding teeth 233 of the toothed disk 23. Further, the thimble 28 secures the above elements by means of a C-shaped ring 212.

In changing the codes, the plurality of sliding rings 24 and the plurality of toothed disks 23 are pushed by pressing the ringed controlling slider 27, which is connected to an elastic element 22 so as to compress the elastic element 22 and make the protruding teeth 233 of the toothed disk 23 separate from the withholding holes 254 of the numeral dials 25. Thus new codes can be set by turning the plurality of numeral dials.

Nevertheless, this common numeral lock has undesirable disadvantages as follows:

1. There are too many types of complicated elements so as to render the locks structure complicated and of high cost.
2. When users want to change the codes, they must keep pressing the ringed controlling slider 27, from the beginning to the end of the operation, with one hand while they are turning the numeral dials 25 with the other hand. Thus, this renders the code setting relatively inconvenient.

SUMMARY OF THE INVENTION

The combination lock body structure comprises a spindle and a combination of a thimble setting push ring, numeral dials, a plurality of toothed disks, a plurality of fixing holders, an elastic elements and a lock barrel which is inserted by the spindle and fixed by a fixing pin through an inserting hole of the lock barrel and a fixing hole of the spindle.

The characteristic of the present invention is acquired to overcome the disadvantages mentioned in the Background of the Invention, wherein the elastic fixing ring, the sliding ring and the ringed controlling slider of the prior art are replaced with the fixing holder and the elastic element.

Thus the elements are simplified.

An further when the thimble is turned, a convex block will be made to push a linked set of the setting push ring, the toothed disk and the fixed holder to move forward, the convex teeth of the toothed disk will be made to separate from withholding holes of the numeral dials. Thus by means of turning the numeral dials, new codes can be set after turning the thimble back to its original position.

BRIEF DESCRIPTION OF THE DRAWINGS

The invention will be better understood by reference to the accompanying drawings, wherein.

DESCRIPTION OF THE PREFERRED EMBODIMENTS

Figure 1:
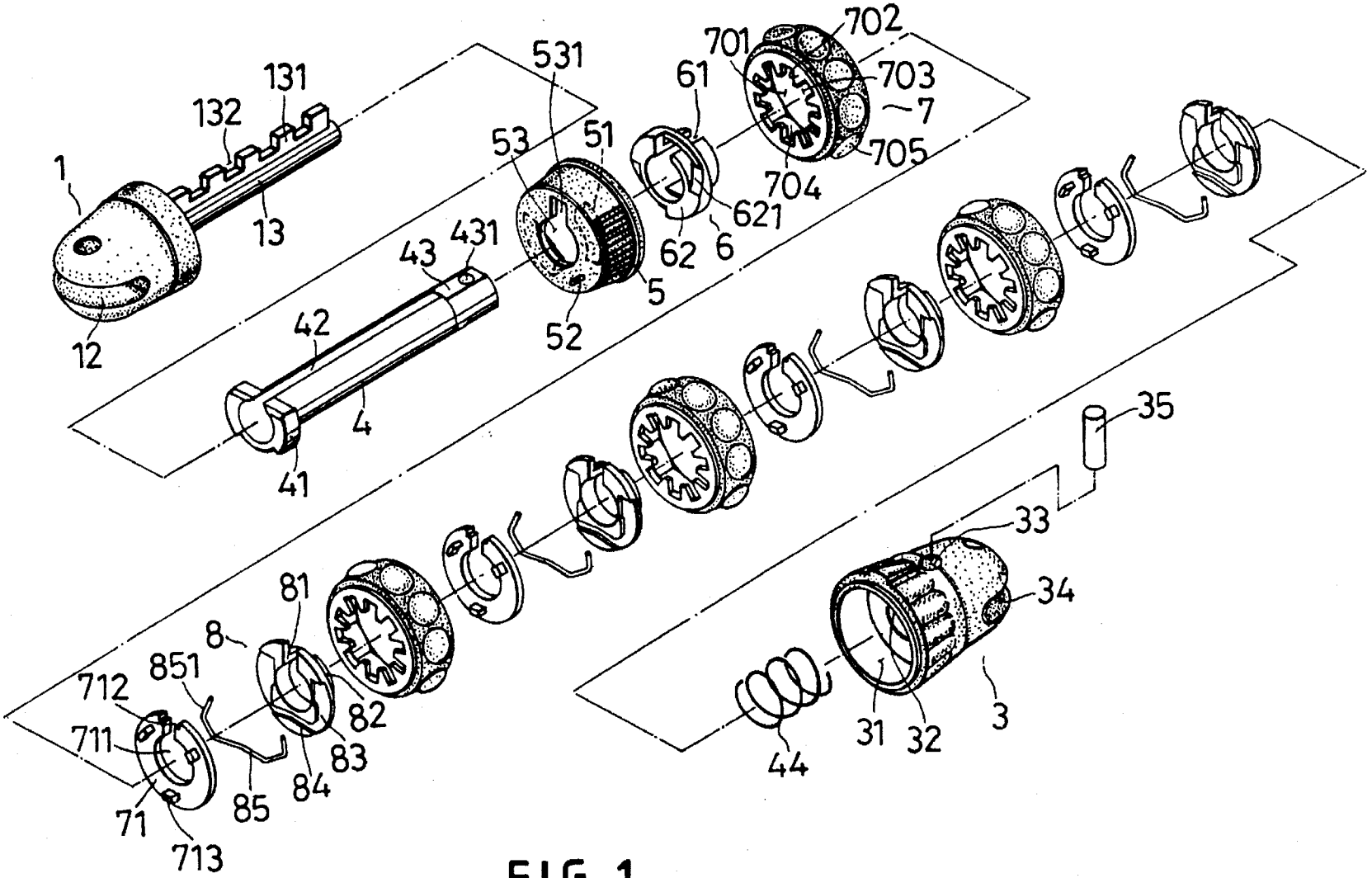
FIG. 1 is an exploded view of a combination lock body of the present invention.

A combination lock structure, as shown in FIG. 1 –FIG. 12, comprises a lock bar 1, a barrel 3, a spindle 4, a thimble 5, a setting push ring 6, a plurality of numeral dials 7 and fixing holders 8.

Figure 2:
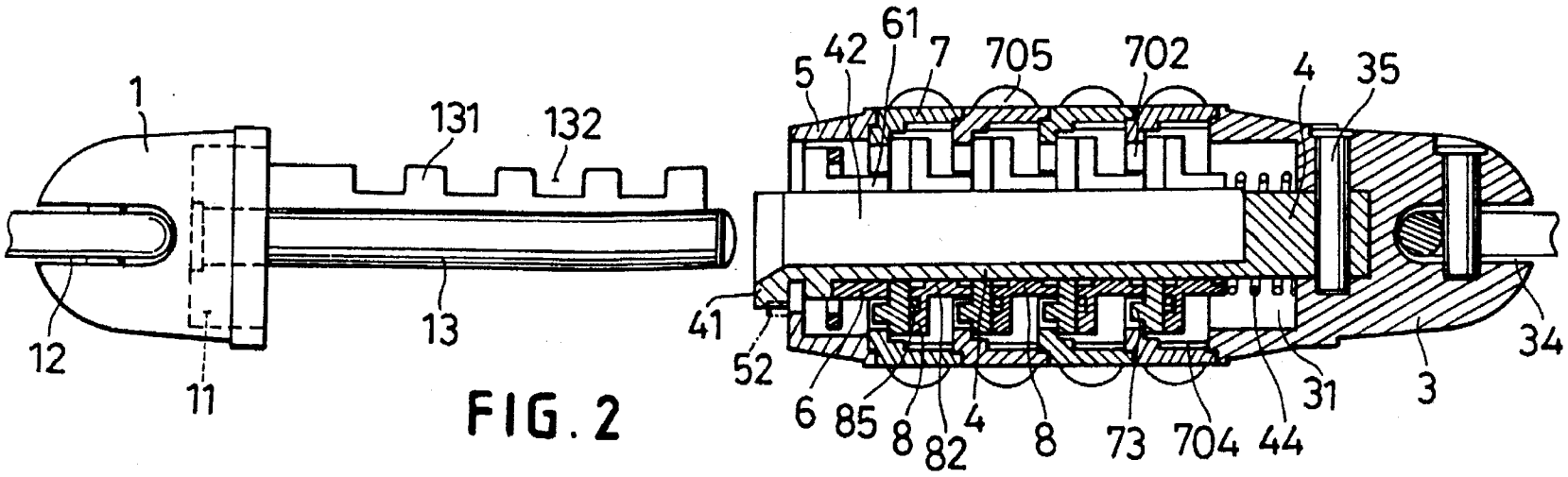
FIG. 2 is a side cross-sectional view of the lock body of the present invention.

The lock bar 1 has a cavity 11, as shown in FIG. 2, and a flat channel 12 formed in one end thereof for coupling to a securement member. An inserting rod 13 extends from the center of the cavity 11 and has a plurality of blocking teeth 131 therebetween.

The barrel 3 has a cavity 31, a concave groove 32 with flat surfaces on upper and lower walls, an insertion hole 33 in the barrel 3 body and a flat channel 34 is formed on the end opposite the cavity 31 for coupling to a securement member.

The spindle 4 has a pair of radially aligned outwardly extending convex flanges 41 formed on the front end thereof. A channel 42 extends longitudinally from the front end of spindle 4. Spindle 4 has a flat surface 44, as best sen in FIG. 5, on the bottom thereof and a flat surface at rear end 43 of the spindle 4. An insertion hole 31 is formed in the flat surface of the rear end 43.

A thimble 5 is included which is shaped as a ring and has a pair of protruding blocks 51 extending from one side, a blocking block 52 extending from an opposing side, and in the center thereof an inserting hole 53. An opening 531 extends radially from the hole 53. A setting push ring 6 is provided with a bottom end cut flat and having a gap 61 formed longitudinally in ring 6. A pair of arcuate edges 62, each having an inclined surface 621 are radially aligned on opposing sides of the gap 61. The numeral dials 7 each have an inserting hole 701, with a plurality of protruding teeth 702 equally spaced around the periphery of hole 701 and a plurality of withholding holes 703 in between the teeth. A plurality of curved convex surfaces 704 are equally spaced on the internal circumference of dial 7 and a plurality of numeral convex surfaces 705 having numerals marked thereon are equally spaced on the outer circumference thereof. Further, each numeral dial 7 can be combined with a toothed disk 71. The toothed disk 71 has an inserting hole 711, a gap 712 and a plurality of protruding teeth 713 equally spaced on the side wall thereof. A fixing holder 8 is provided having a gap 81, a pair of convex edges 82 and further a pair of open recesses 83 on the other side, the side opposite to the convex edges 82. The open recesses 83 are connected by a suitably shaped concave recess 84. The elastic element 85 is set into the space formed by the pair of open recesses 83 and the concave recess 84. Further, the elastic element 85 is shaped with two withholding ends 851 which protrude outwardly to press and rest on the curved convex surfaces 704 of a respective numeral dial 7.

In assembling the lock, as shown in FIG. 2, first the spindle is inserted into the thimble 5, and then the setting push ring 6 is put into the thimble 5, with the gap 61 of the setting push ring 6 aligned with the channel 42 of the spindle 4. Thereafter, the numeral dial 7, the toothed disk 71, and the fixing holder 8 are inserted on the spindle 4 in sequence wherein the gap 81 of the fixing holder 8 is aligned with the channel 42 of the spindle 4. A plurality of sets comprising a numeral dial 7, a toothed disk 71 and a fixing holder 8 are combined together in sequence as numeral units and are inserted on the spindle 4. An elastic element 44 is set into the outside of the most external fixing holder 8. Then, the spindle 4 is positioned to go through the concave groove 32 of the barrel 3 and an inserting pin 35 is installed through the inserting hole 33 of the barrel 3 and the fixing hole 431 of the spindle 4 to affix the relative position of the aforesaid element, which elements are inserted on the spindle 4.

Figure 3:
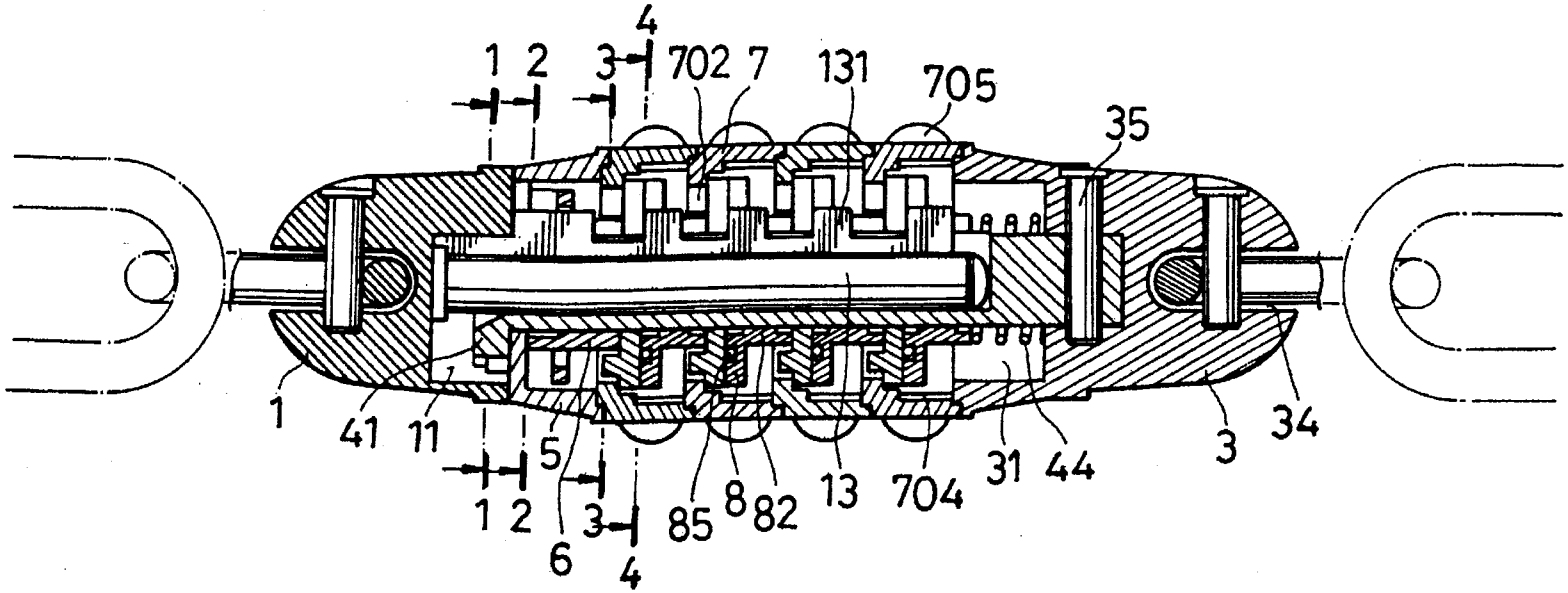
FIG. 3 is a side cross-sectional view of the lock body with the lock bar inserted.
Figure 4:
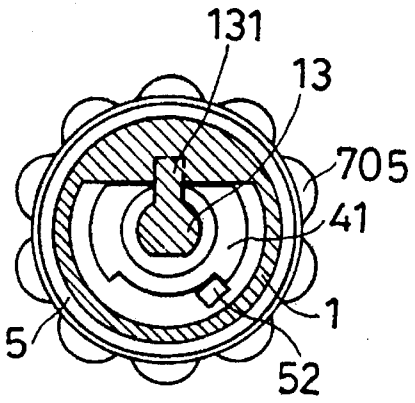
FIG. 4 is a cross-sectional view taken along the section line 1—1 of FIG. 3.
Figure 5:
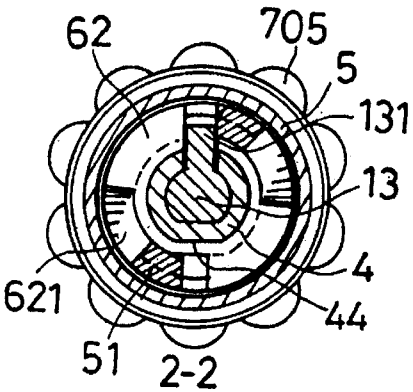
FIG. 5 is a cross-sectional view taken along the section line 2—2 of FIG. 3.

In using the lock, as shown in FIG. 3 to FIG. 5, the lock will be locked after the lock bar 1 is put into the channel 4 of the spindle and the numeral dials 7 are turned while the lock will be unlocked when the numeral dials 7 are each turned to their respective preset numeral position.

Figure 6:
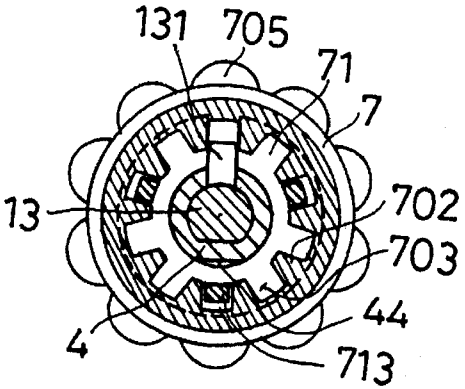
FIG. 6 is a cross-sectional view taken along the section line 3—3 of FIG. 3.
Figure 8:
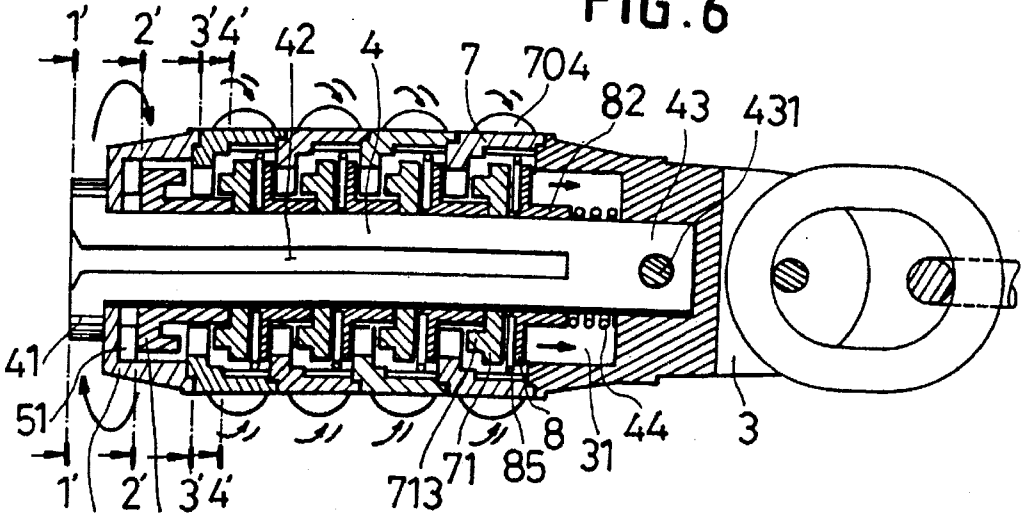
FIG. 8 is a side cross-sectional view showing the action of changing the codes.
Figure 7:
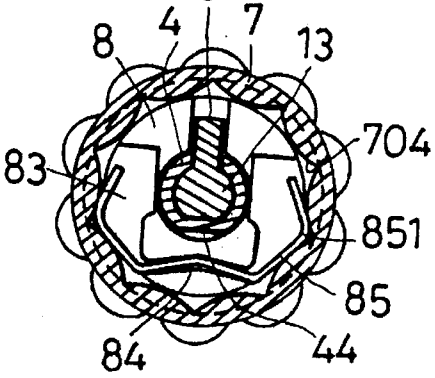
FIG. 7 is a cross-sectional view taken along the section line 4—4 of FIG. 3.
Figure 11:
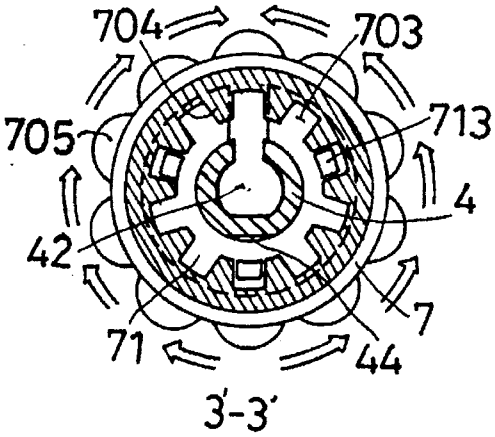
FIG. 11 is a cross-sectional view taken along the section line 3'—3' of FIG. 8.
Figure 10:
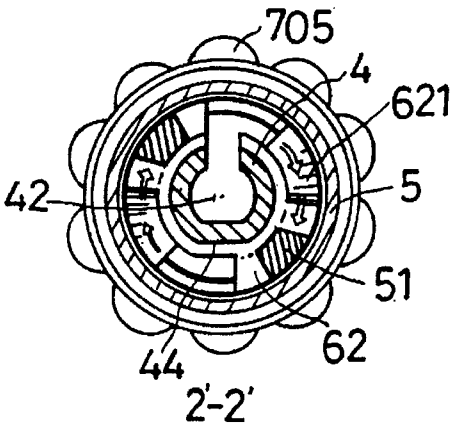
FIG. 10 is a cross-sectional view taken along the section line 2'—2' of FIG. 8.
Figure 9:
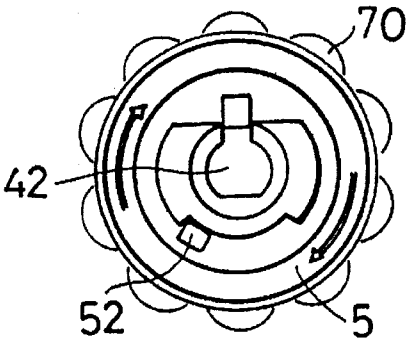
FIG. 9 is a cross-sectional view taken along the section line 1'—1' of FIG. 8.
Figure 12:
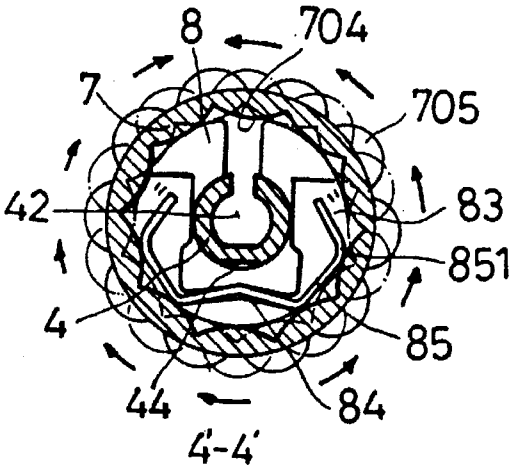
FIG. 12 is a cross-sectional view taken along the section line 4'—4' of FIG. 8; and, FIG. 13 is the exploded view of a prior combination lock.
Figure 13:
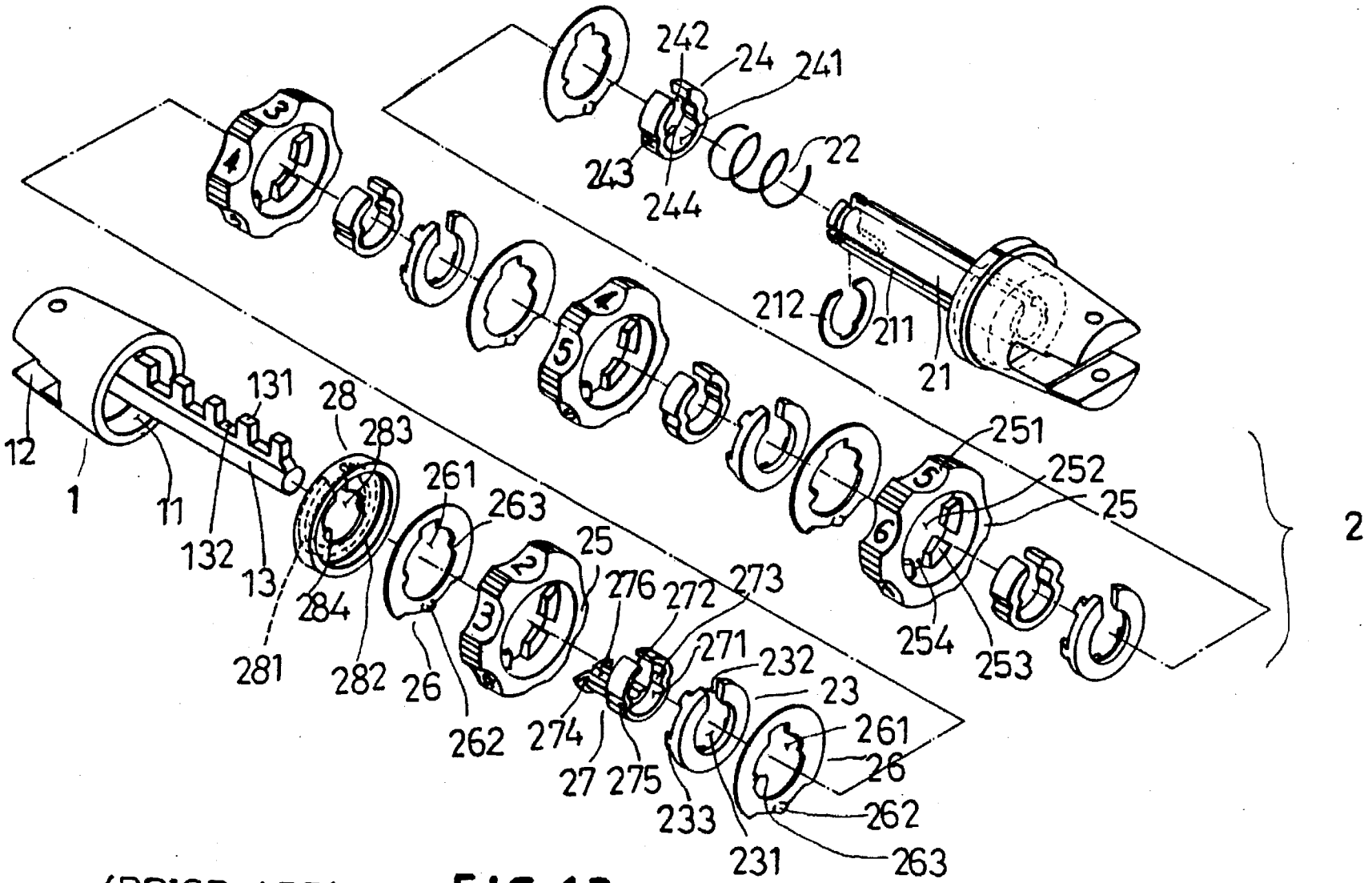
FIG. 13 (PRIOR ART)

In setting a new code, as shown in FIG. 6 and FIG. 7, the thimble 5 is turned clockwise until the blocking block 52 is stopped by the convex flange 41 of the spindle 4. The protruding blocs 51, inside the thimble 5, are thereby made to push the setting push ring 6, the toothed disk 71 and the fixing holder 8 to move forward so as to make the convex teeth 713 of the toothed disk 71 separated from the withholding holes 703 of the numeral dials 7. Under this condition, the gap 712 of the toothed disk 71 remains aligned with the channel 42 of the spindle 4 when the numeral dials 7 are being turned. In this way, new codes can be set. After the codes are set, the thimble 5 is turned to its original position and the setting push ring 6, the toothed disk 71 and the fixing holder 8 will be released and pushed back to its original position by means of the bias force of the elastic element 44.

While the preferred embodiment of the invention has been described above, it will be recognized and understood that various modifications may be made thereto and the appended claims are intended to cover all such modifications which may fall within the spirit and scope of the invention.

What is claimed is:

1. A combination lock body structure comprising:

a lock bar having a first channel formed in one end thereof for coupling to a securement member and an inserting rod extending from an opposing end, said inserting rod having a plurality of longitudinally spaced blocking teeth formed thereon;

a longitudinally extended spindle having a pair of radially aligned outwardly extending convex flanges formed on a front end thereof, said spindle being formed with an elongated channel extending longitudinally from said front end for receiving said inserting rod therein, said spindle having hole formed through a rear end thereof;

a barrel member coupled to said rear end of said spindle and having an outer wall extending from an open first end to a closed second end to define a cavity therein, said barrel member having a second channel formed in said second end for coupling to the securement member, said barrel member having an aperture formed through said outer wall and in open communication with said cavity and in alignment with said hole in said spindle for receiving a pin through said hole and said aperture;

a plurality of numerical code wheel sets rotatably disposed on said spindle between said barrel and said front end of said spindle, each of said plurality of numerical code wheel sets including (a) a numeral dial rotatable on said spindle having an outer peripheral wall formed in a closed contour with spaced numeral markings on an external surface thereof and a plurality of curved convex surfaces formed on an internal surface of said peripheral wall, said numeral dial having a central through opening for passage of said spindle therethrough and a plurality of first protruding teeth equally spaced around a peripheral edge of said central through opening, (b) a tooth dish member disposed within said closed contour of said numeral dial peripheral wall and having a plurality of second protruding teeth extending from one side thereof for engagement with said first protruding teeth of said numeral dial, said tooth dish member having a first gap formed radially therein and alignable with said elongated channel of said spindle and rotatable with, (c) a fixing holder rotatable on said spindle and having a second gap formed radially therein and disposed in aligned relationship with said first gap, said fixing holder having a first side disposed adjacent said tooth dish member and a second side with a pair of convex edges extending therefrom insertable through said central through opening of said numeral dial of an adjacent numerical code wheel set, said first side of said fixing holder having a pair of spaced open recesses formed therein and each having a respective end thereof in open communication with the other, and (d) a first elastic element having a pair of opposing side portions respectively disposed in said pair of open recesses and a pair of opposing ends extending from said open recesses for engagement with a respective pair of said plurality of curved convex surfaces of said numeral dial;

means for setting a code rotatably disposed on said spindle between said convex flanges thereof and said plurality of numerical code wheel sets, said code setting means including (a) a thimble member having a central opening for rotatable coupling to said spindle with a first side thereof disposed adjacent said convex flanges of said spindle, said thimble having a pair of protruding blocks formed on a second side thereof, and (b) a setting push ring longitudinally slidably coupled to said spindle and having one side thereof disposed adjacent said second side of said thimble member, said setting push ring having a third gap formed radially therein and disposed in aligned relationship with said elongated channel of said spindle, said one side of said setting push ring having a pair of spaced arcuate edges extending from a respective pair of inclined surfaces, said setting push ring being longitudinally displaced to thereby displace said tooth dish member's engagement with said numeral dial of each of said plurality of numerical code wheel sets responsive to rotation of said thimble member to respectively contact said pair of spaced arcuate edges with said pair of protruding blocks; and, a second elastic element disposed between said barrel member and said fixing holder of a respective one of said plurality of numerical code wheel sets disposed adjacent said barrel member.

* * * * *